US005634386A

United States Patent [19]

Gasparetto

[11] Patent Number: 5,634,386

[45] Date of Patent: Jun. 3, 1997

[54] WEDGE CUTTING JIG DEVICE

[76] Inventor: Larry Gasparetto, 217 Bannerman, South Porcupine Ontario P0N 1H0, Canada

[21] Appl. No.: 656,888

[22] Filed: May 30, 1996

[51] Int. Cl.[6] ..... B26D 7/06

[52] U.S. Cl. ..... 83/432; 33/423; 83/435.14; 83/437.1; 83/730; 144/204.2; 409/36; 409/234

[58] Field of Search ..... 33/423, 426, 465, 33/415, 418; 83/412, 415, 431, 432, 730, 743, 745, 454, 435.14, 435.11, 437; 144/204.2; 269/303; 409/36, 234

[56] References Cited

U.S. PATENT DOCUMENTS

| | | | |
|---|---|---|---|
| 1,713,329 | 5/1929 | Clayton | 144/204.2 |
| 2,085,236 | 6/1937 | Tantz | 144/204.2 |
| 2,895,513 | 7/1959 | Cowley | 144/204.2 |
| 3,842,700 | 10/1974 | Novak | 83/743 |
| 5,201,863 | 4/1993 | Peot | 83/432 |

*Primary Examiner*—W. Donald Bray

[57] ABSTRACT

A new Wedge Cutting Jig Device for offering a tool that enables one to cut wood wedges and shims and the like with a variety of thicknesses. The inventive device includes a base, a handle, a wood pocket, a wood push wall, and a thickness adjustment means. In use, an ordinarily and otherwise scrap lumber end is placed on a table saw and the Wedge Cutting Jig Device 10 is taken by the hand of the operator. The operator turns the table saw on, and with the Wedge Cutting Jig Device 10 sliding down a slot of the table saw with the slide rail 22 of the Wedge Cutting Jig Device 10 being slidably received within the slot of the table saw, the scrap lumber end is safely forced past the turning blade of the table saw and results in a wood wedge being cut out.

8 Claims, 3 Drawing Sheets

WEDGE CUTTING JIG DEVICE

BACKGROUND OF THE INVENTION

1. Field of the Invention

The present invention relates to wood working tools and more particularly pertains to a new Wedge Cutting Jig Device for offering a tool that enables one to cut wood wedges and shims and the like with a variety of thicknesses.

2. Description of the Prior Art

The use of wood working tools is known in the prior art. More specifically, wood working tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art wood working tools include U.S. Pat. Nos. 4,892,021; 3,979,987; U.S. Pat. Des. 318,409; U.S. Pat. Nos. 4,901,444; 5,352,075; and 4,608,761.

While these devices fulfill their respective, particular objectives and requirements, the aforementioned patents do not disclose a new Wedge Cutting Jig Device. The inventive device includes a base, a handle, a wood pocket, a wood push wall, and a thickness adjustment means.

In these respects, the Wedge Cutting Jig Device according to the present invention substantially departs from the conventional concepts and designs of the prior art, and in so doing provides an apparatus primarily developed for the purpose of offering a tool that enables one to cut wood wedges and shims and the like with a variety of thicknesses.

SUMMARY OF THE INVENTION

In view of the foregoing disadvantages inherent in the known types of wood working tools now present in the prior art, the present invention provides a new Wedge Cutting Jig Device construction wherein the same can be utilized for offering a tool that enables one to cut wood wedges and shims and the like with a variety of thicknesses.

The general purpose of the present invention, which will be described subsequently in greater detail, is to provide a new Wedge Cutting Jig Device apparatus and method which has many of the advantages of the wood working tools mentioned heretofore and many novel features that result in a new Wedge Cutting Jig Device which is not anticipated, rendered obvious, suggested, or even implied by any of the prior art wood working tools, either alone or in any combination thereof.

To attain this, the present invention generally comprises a base, a handle, a wood pocket, a wood push wall, and a thickness adjustment means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in tile following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in tile art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Wedge Cutting Jig Device apparatus and method which has many of the advantages of the wood working tools mentioned heretofore and many novel features that result in a new Wedge Cutting Jig Device which is not anticipated, rendered obvious, suggested, or even implied by any of the prior art wood working tools, either alone or in any combination thereof.

It is another object of the present invention to provide a new Wedge Cutting Jig Device which may be easily and efficiently manufactured and marketed.

It is a further object of the present invention to provide a new Wedge Cutting Jig Device which is of a durable and reliable construction.

An even further object of the present invention is to provide a new Wedge Cutting Jig Device which is susceptible of a low cost of manufacture with regard to both materials and labor, and which accordingly is then susceptible of low prices of sale to the consuming public, thereby making such Wedge Cutting Jig Device economically available to the buying public.

Still yet another object of the present invention is to provide a new Wedge Cutting Jig Device which provides in the apparatuses and methods of the prior art some of the advantages thereof, while simultaneously overcoming some of the disadvantages normally associated therewith.

Still another object of tile present invention is to provide a new Wedge Cutting Jig Device for offering a tool that enables one to cut wood wedges and shims and the like with a variety of thicknesses.

Yet another object of the present invention is to provide a new Wedge Cutting Jig Device which includes a base, a handle, a wood pocket, a wood push wall, and a thickness adjustment means.

Still yet another object of the present invention is to provide a new Wedge Cutting Jig Device that enables the quick and handy production of wood wedges and shims.

Even still another object of the present invention is to provide a new Wedge Cutting Jig Device that enables the more efficient usage of ordinarily otherwise scrap lumber ends.

These together with other objects of tile invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
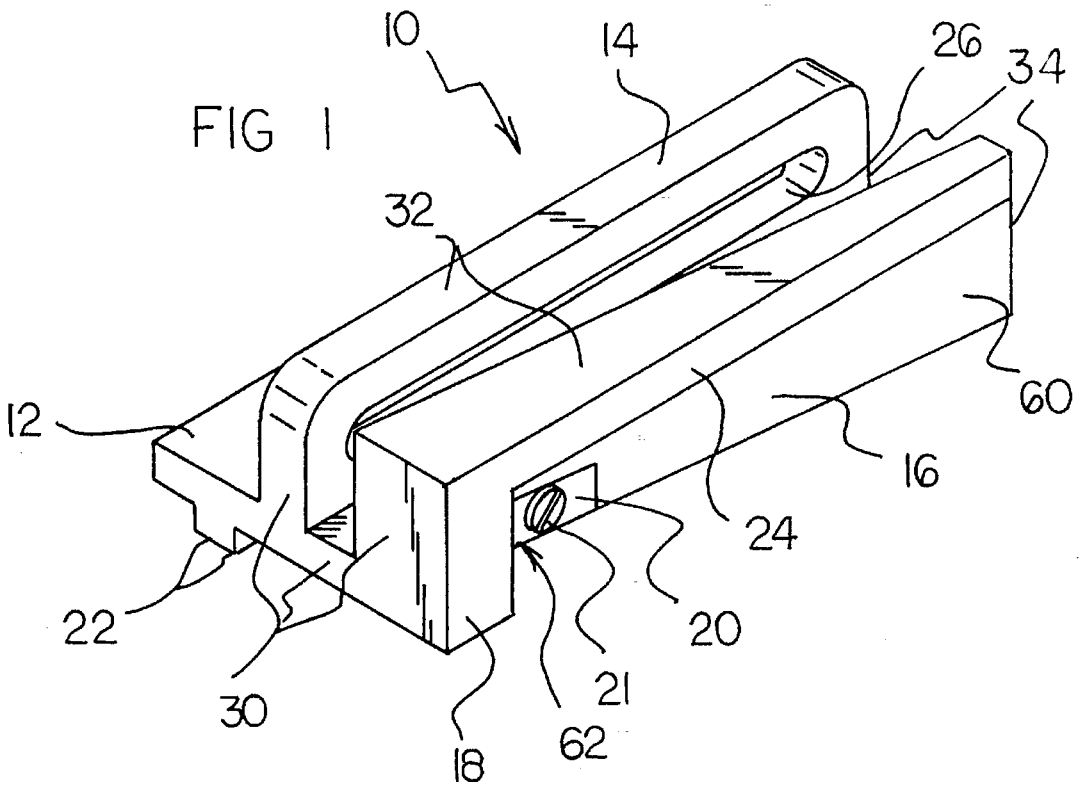
FIG. 1 is a right side perspective view of a new Wedge Cutting Jig Device according to the present invention.
Figure 2:
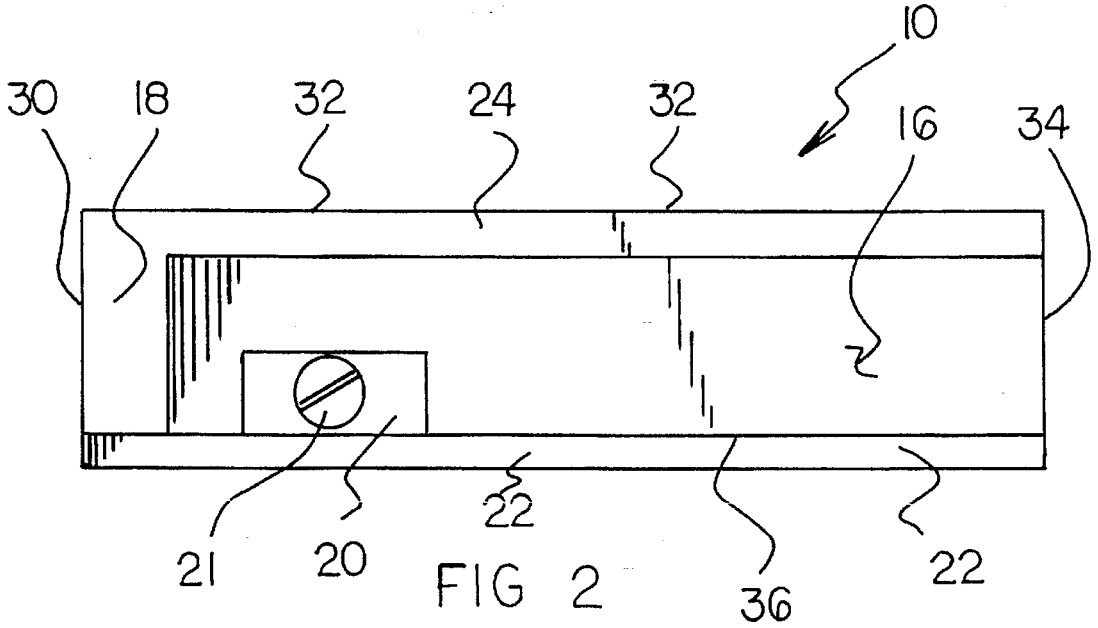
FIG. 2 is a side elevation view thereof.
Figures 3, 4:
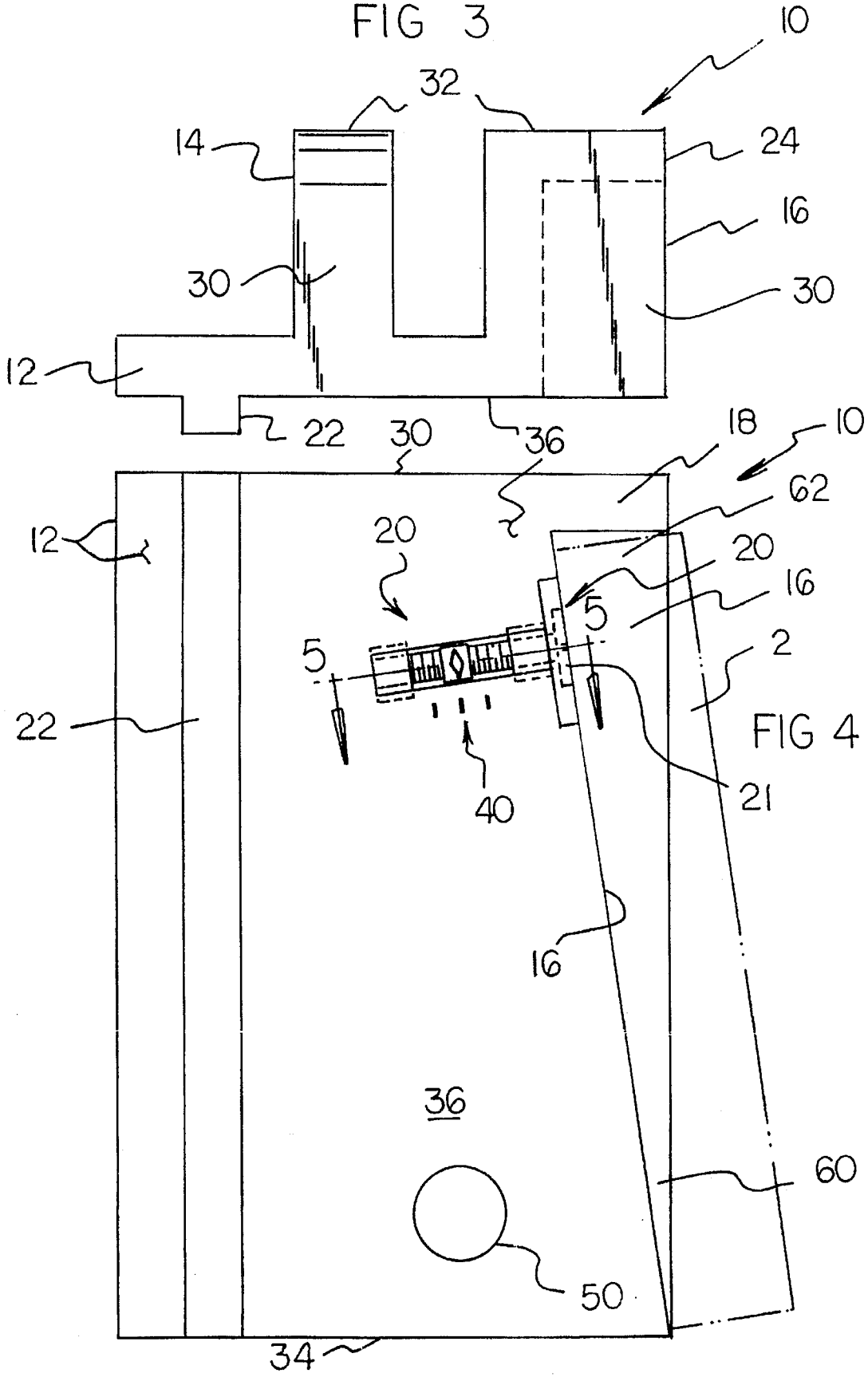
FIG. 3 is an end elevation view of the present invention.
FIG. 4 is a bottom view of the invention.

With reference now to the drawings, and in particular to FIGS. 1 through 6 thereof, a new Wedge Cutting Jig Device embodying the principles and concepts of the present invention and generally designated by the reference numeral 10 will be described.

More specifically, it will be noted that the Wedge Cutting Jig Device 10 comprises a base 12, a handle 14, a wood pocket 16, a wood push wall 18, and an adjustment means 20 for the adjustment of thickness of a wood piece 2.

The base 12 is further comprised of a slide rail 22 which extends down from the base 12 and normal to the base 12 and runs the full length of the base 12. In addition to this, the handle 14 extends up from the base 12 and normal to the base 12 and runs the full length of the base 12 and is parallel to the slide rail 22 and further includes an elongated finger slot 26 which also is parallel to the slide rail 22.

The base 12 is still further comprised of the wood pocket 16 which is further defined as a vertical upward normal extension of the base 12 and runs full length of the base 12 and is parallel to the handle 14 and includes a top retaining wall 24 which is perpendicular to the wood pocket 16 and where the wood push wall 18 is an integral extension of and normal to each the wood pocket 16 and the top retaining wall 24.

The base 12 is further defined as having a front surface 34, a rear surface 30, a top surface 32, and a bottom surface 36, where the bottom surface 36 slides upon the surface of a saw table, the top surface 32 is adjacent and touched by the operator, the rear surface 30 is oriented toward and adjacent to the operator, and the front surface 34 is oriented toward and adjacent to the wood piece 2 and the saw and the saw blade.

The wood pocket 16 is further defined as having a shallow end 60 and a deep end 62 where the adjustment means 20 is located near the deep end 62 and is an aperture in the wood pocket 16.

The preferred embodiment of the Wedge Cutting Jig Device 10 is made generally of a material such as hardened rubber, plastic, or metal.

Figure 5:
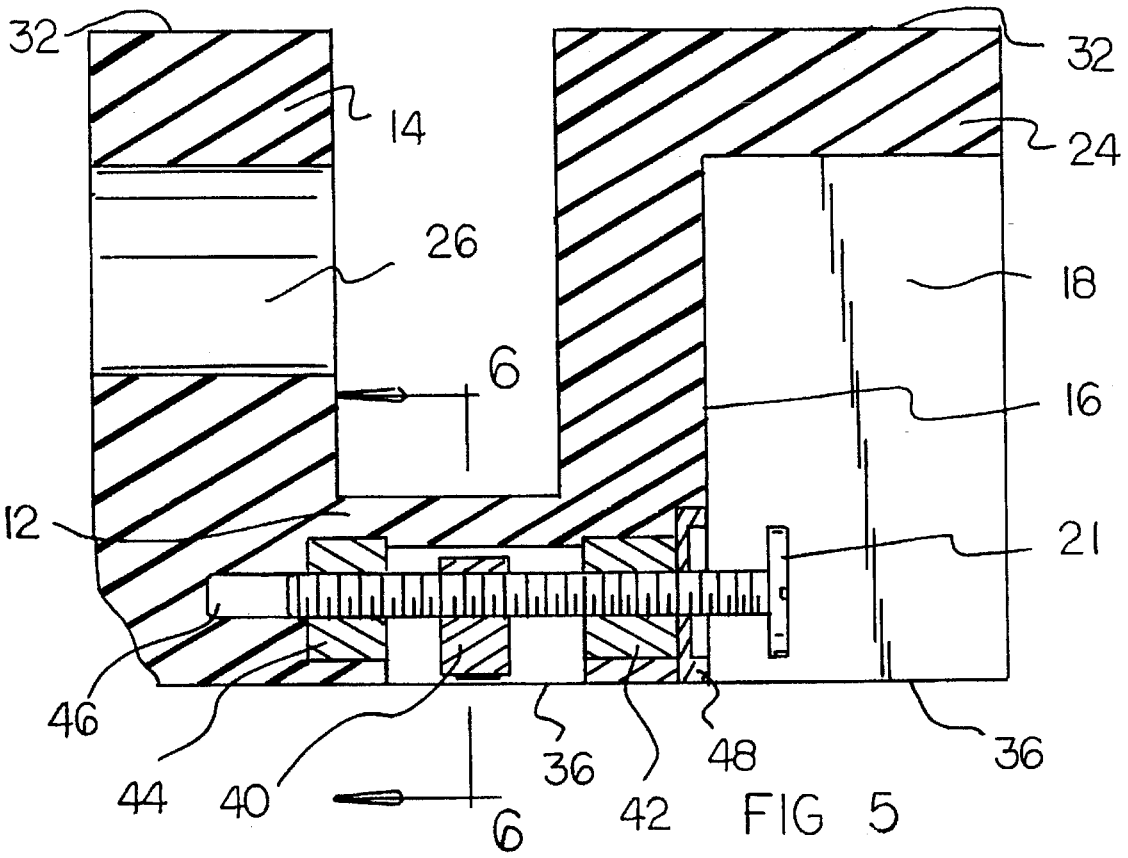
FIG. 5 is a cross sectional view taken along line 5—5 of FIG. 4.
Figure 6:
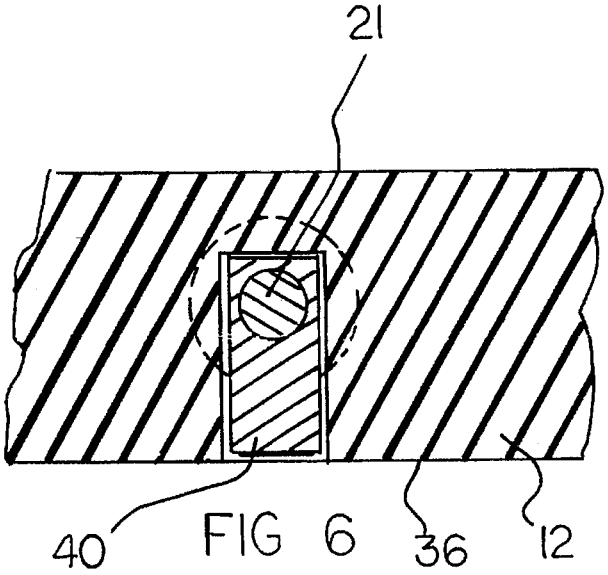
FIG. 6 is a cross sectional view taken along line 6—6 of FIG.

As best illustrated in FIGS. 1 through 6 and with particular attention to FIG. 5, it can be shown that the adjustment means 20 further comprises an adjustment screw 21 which is slidably received within a screw guide 42 and is threadedly received by a nut follower 44 wherein upon turning the adjustment screw 21, the adjustment screw 21 moves to and fro through the screw guide 42 and the nut follower 44 and a screw slot 46. In addition to this, the adjustment means 20 also includes a thickness indicator 40, which the adjustment screw 21 also moves to and fro through. The screw guide 42 and the nut follower 44 are retained in place by a retaining nut 48 which is formed to matingly receive a head of the adjustment screw 21.

In use, an ordinarily and otherwise scrap lumber end is placed on a table saw and the Wedge Cutting Jig Device 10 is taken by the hand of the operator. The operator turns the table saw on, and with the Wedge Cutting Jig Device 10 sliding down a slot of the table saw with the slide rail 22 of the Wedge Cutting Jig Device 10 being slidably received within the slot of the table saw, the scrap lumber end is safely forced past the turning blade of the table saw and results in a wood wedge being cut out. "The workpiece, during the cutting operation, holds the Wedge Cutting Jig Device 10 up off the table saw, therefore supporting the Wedge Cutting Jig Device 10 in a horizontally level position."

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wedge cutting jig device comprising: a base, a handle, a wood pocket, a wood push wall, and a thickness adjustment means and a slide rail which extends down from the base and normal to the base and runs the full length of the base and where the handle extends up from the base and normal to the base and runs the full length of the base and is parallel to the slide rail and further includes an elongated finger slot which also is parallel to the slide rail.

2. The wedge cutting jig device of claim 1, wherein the wood pocket which is further defined as a vertical upward normal extension of the base and runs full length of the base and is parallel to the handle and includes a top retaining wall which is perpendicular to the wood pocket and where the wood push wall is an integral extension of and normal to each the wood pocket and the top retaining wall.

3. The wedge cutting jig device of claim 2, wherein the base is further defined as having a front surface, a rear surface, a top surface, and a bottom surface, where the bottom surface slides upon the surface of a saw table, the top surfaces adjacent and touched by the operator, the rear surface is oriented toward and adjacent to the operator, and the front surface is oriented toward and adjacent to the wood piece and the saw and the saw blade.

4. The wedge cutting jig device of claim 3, wherein the wood pocket is further defined as having a shallow end and a deep end where the adjustment means is located near the deep end and is an aperture in the wood pocket.

5. The wedge cutting jig device of claim 4, wherein the preferred embodiment of the Wedge Cutting Jig Device is made generally of a material such as hardened rubber, plastic, or metal.

6. The wedge cutting jig device of claim 5, wherein the adjustment means further comprises an adjustment screw which is slidably received within a screw guide and is threadedly received by a nut follower wherein upon turning the adjustment screw, the adjustment screw moves to and fro through the screw guide and the nut follower and a screw slot.

7. The wedge cutting jig device of claim 6, wherein the adjustment means also includes a thickness indicator in which the adjustment screw also moves to and fro through.

8. The wedge cutting jig device of claim 7, wherein the screw guide and the nut follower are retained in place by a retaining nut which is formed to matingly receive a head of the adjustment screw.

* * * * *